US006432230B1

(12) United States Patent
Köck et al.

(10) Patent No.: US 6,432,230 B1
(45) Date of Patent: Aug. 13, 2002

(54) PROCESS AND DEVICE FOR HARDENING A RAIL

(75) Inventors: Norbert Köck, St. Peter-Freienstein; Peter Pointner, Leoben, both of (AT)

(73) Assignee: Voest-Alpine Schienen GmbH & Co. KG, Leoben-Donawitz (AT)

( * ) Notice: Subject to any disclaimer, the term of this patent is extended or adjusted under 35 U.S.C. 154(b) by 0 days.

(21) Appl. No.: 09/665,121

(22) Filed: Sep. 20, 2000

(30) Foreign Application Priority Data

May 29, 2000 (AT) ..... 939/2000

(51) Int. Cl.[7] ..... C21D 9/04; C21D 9/06; C21D 1/62

(52) U.S. Cl. ..... 148/646; 148/645; 148/581; 148/585; 266/114

(58) Field of Search ..... 148/581, 584, 148/585, 645, 646; 266/114

(56) References Cited

U.S. PATENT DOCUMENTS

| | | | | |
|---|---|---|---|---|
| 125,650 A | * | 4/1872 | Woodbury | 148/646 |
| 368,132 A | * | 8/1887 | Coffin | 148/646 |
| 4,895,605 A | | 1/1990 | Ackert et al. | |
| 4,913,747 A | | 4/1990 | Fukuda et al. | |
| 5,054,746 A | | 10/1991 | Buchegger | |
| 5,440,889 A | | 8/1995 | Sippel et al. | |

FOREIGN PATENT DOCUMENTS

| | | |
|---|---|---|
| AT | 323224 | 6/1975 |
| AT | 402941 | 9/1997 |
| CA | 2116216 | 2/1994 |
| CA | 2154090 | 1/1996 |
| DE | 4003363 | 3/1991 |
| DE | 4237991 | 5/1994 |
| EP | 0358362 | 3/1990 |
| EP | 0186373 | 9/1990 |
| GB | 1370144 | 10/1974 |
| WO | 94/02652 | 2/1994 |

OTHER PUBLICATIONS

English Language Abstract of AT 402 941 B., Sep. 1997.
English Language Abstract of DE 42 37 991 A1. May 1994.
English Language Abstract of DE 40 03 363 C1. Mar. 1991.
F. Rapatz, "Die Edelstähle", Springer–Verlag Berlin, Germany, 1962, pp. 2–25.

* cited by examiner

*Primary Examiner*—Deborah Yee
(74) *Attorney, Agent, or Firm*—Greenblum & Bernstein, P.L.C.

(57) ABSTRACT

Process and device for hardening a rail. The process for hardening a rail or part thereof by transforming it from an austenitic structure into a different microstructure that is stable at room temperature comprises aligning, horizontally positioning, and fixing in axial alignment to secure against bending, the rail in its austenitic state; and while keeping the rail fixed in axial alignment and secured against bending, force-cooling the rail or part thereof to allow the austenitic structure to be transformed into said different microstructure. The device for hardening a rail or part thereof by force-cooling comprises a support for supporting the rail; a cooling device for force-cooling the rail or part thereof; and at least two fixing devices for axially aligning and securing the rail against bending during the force-cooling.

35 Claims, 1 Drawing Sheet

PROCESS AND DEVICE FOR HARDENING A RAIL

CROSS-REFERENCE TO RELATED APPLICATIONS

The present application claims priority under 35 U.S.C. §119 of Austrian Patent Application No. 939/2000, filed on May 29, 2000, the disclosure of which is expressly incorporated by reference herein in its entirety.

BACKGROUND OF THE INVENTION

1. Field of the Invention

The invention relates to a process for hardening a rail or part thereof (e.g., the rail head) by forced cooling and a device for carrying out a corresponding process.

2. Discussion of Background Information

For the growing railway traffic with its increasing axle loads rails should, on the one hand, have high wear resistance in the area that comes into contact with the train wheels and, on the other hand, have high resistance to fracture in view of the high bending load acting on the rail.

Thermally tempering the (steel) material or changing the structure from an austenitic structure into a microstructure that is stable at room temperature during at least temporary force-cooling is known to harden the rail and/or the rail head (EP-358362 A1, AT 402941 B, EP186373 B, WO 94/02652).

Cooling can be effected by subjecting at least a part of the rail surface to coolant, a so-called splash cooling or spray cooling, or by at least partially submerging the rail into a coolant bath, wherein the advantageous use of the rolling heat is known in the art.

Depending on the cooling method used, pass-through processing devices (AT 323224 B, EP 186373 B1), cooling bed transport devices (DE 4237991 A1) and submerging devices (DE 4003363 C1, AT 402941 B) are known for forced cooling of the rail or parts thereof.

When alloys with an appropriate chemical composition are used, rails with increased hardness and wear resistance in the area of the surface of the rail head and with sufficient resistance to fracture can be produced by using hardening processes in the appropriate devices.

A possible lack of homogeneity of the structural distribution over the cross-section as a function of the length of the rail must be considered a great disadvantage of the known hardening processes and cooling devices for rails. In other words, if the portion of the surface area of the relevant tempering structure and/or the position of the structural constituents in the rail cross-section is uneven over the length of the rail this has an increasingly detrimental effect on the quality of the rail. Even if process parameters are maintained precisely and cooling devices are controlled precisely, unexpected differences in the quality of the rail can occur, resulting in some individual rails that do not meet the quality requirements of an extremely sophisticated quality control.

SUMMARY OF THE INVENTION

The present invention is directed to overcoming the above problems by providing a process of the above mentioned type which results in a constant structural distribution over length across the rail cross-section and a high rail quality.

The present invention furthermore is directed to providing a device for hardening a rail or parts thereof through which the local cooling intensity of the surface regions of the cross-section can be kept constant over the length of the rail.

One aspect of the present invention is a process for hardening a rail or part thereof by transforming it from an austenitic structure into a different microstructure that is stable at room temperature, the process comprising aligning, horizontally positioning, and fixing in axial alignment to secure against bending, the rail in its austenitic state; and while keeping the rail fixed in axial alignment and secured against bending, force-cooling the rail or part thereof to allow the austenitic structure to be transformed into said different microstructure.

In one embodiment of the above process the rail is force-cooled from a first temperature above its $Ac_3$-point to a second temperature which is below said $Ac_3$-point. In another embodiment of the process only the rail head is force-cooled.

It may also be advantageous if alignment, positioning and fixing in axial alignment are conducted immediately after the last finish rolling pass.

In the above process the rail may, for example, be fixed in a standing position, with the rail head pointing (straight) upward, or it may be fixed in a hanging position, with the rail head pointing (straight) downward.

Force-cooling of the rail or part thereof may be accomplished by spray cooling, for example by spray cooling while using equally high cooling intensities in the surface regions of the cross-section symmetrically to the height axis of the rail viewed in longitudinal direction.

In another embodiment of the process of the invention the rail or part thereof may be force-cooled by immersion thereof into a cooling liquid.

In a further embodiment the rail or part thereof may force-cooled intermittently with respect to at least one of time and location with regard to a surface region of the cross-section.

After the force-cooling the rail may be released and kept at an elevated temperature, and/or it may be left to cool in ambient air.

In many cases the length of the rail will be at least about 50 m, e.g., at least about 90 m, and frequently the rail or part thereof will be force-cooled over approximately its entire length.

In another aspect the rail is fixed in axial alignment by means of fixing elements arranged in longitudinal direction of the rail at a distance to each other of not more than about 1 m, e.g., not more than about 0.5 m. These fixing elements may be designed to keep the rail foot in a fixed position.

The $Ac_3$-point referred to above is the temperature of iron or an alloy thereof at which upon heating a purely austenitic ($\gamma$) microstructure is present. For more details as regards the definition of the $Ac_3$-point (and microstructures that are stable at room temperature) reference may, for example, be made to F. Rapatz, "Die Edelstähle", Springer-Verlag Berlin, Germany, 1962, pp. 2–25 (see particularly pages 3 and 12), the disclosure of which is expressly incorporated by reference herein in its entirety.

The advantages achieved through the process of the invention include that alignment occurs in the austenitic structural state and heat is then removed from the rail surface at an increased rate, while it is fixed (clamped) in axial alignment. During the intensive cooling of the rail cross-section or parts thereof the rail remains fixed in axially straight position which helps to keep the specific cooling intensity constant in the axial direction. Extensive research shows that, if even a slight bending of the rail occurs during intensive cooling of the rail or at least parts thereof, the local cooling rate curve in the surface region can change. This has a major effect on the formation of the structure during the change from the austenitic state of the alloy. In a thermal tempering of the rail an axially aligned (flush) horizontal mounting according to the invention secures a constant profile of material properties over the cross-section and over the length of the rail.

A particularly economical embodiment of the process of the present invention is obtainable when aligning (straightening), positioning and fixing in axial alignment of the rail are performed immediately after the last finish rolling pass with utilization of the rolling heat.

For a specific site technology, but also for a desired microstructural distribution over the cross-section of the rail, it may also be advantageous to fix (clamp) the rail in a standing position, with the rail head pointing straight upward. Here, it is advantageous to remove the heat from the rail by spray cooling using equally high cooling intensities in the surface regions of the cross-section symmetrically to the vertical axis of the rail viewed in the longitudinal direction.

In order to improve manufacturing reliability of rails with the desired property profile and to achieve special wear resistance of the surface in contact with the train wheels, it may be advantageous if the rails are mounted hanging with the rail head pointing vertically downward. Another reason why such positioning may prove beneficial is that this way heat may be removed by submerging the rail or only a part thereof (particularly the rail head) into a cooling liquid.

For controlled cooling to a desired temperature with a high cooling intensity of the cooling medium and an interruption of the forced cooling it may be advantageous in terms of transformation kinetics if the cooling of the rail is performed intermittently with respect to time and/or location with regard to a surface region of the cross-section. Here, it may also be beneficial to release (e.g., unclamp) the rail, after the force-cooling, and to keep it at an elevated temperature and/or to allow it to cool in air at ambient temperature.

Use of the present process in which a cooling or hardening or a thermal tempering of the rail occurs over the full length thereof has proven to be particularly beneficial for high uniformity and high quality as well as the attainment of optimal service properties.

Another aspect of the present invention is a device for hardening a rail or part thereof by force-cooling. The device comprises a support for supporting the rail; a cooling device for force-cooling the rail or part thereof; and at least two fixing devices for axially aligning and securing the rail against bending during the force-cooling.

The support advantageously comprises a support structure having a high resistance to bending. This support structure may comprise a welded structure having the fixing devices horizontally arranged thereon.

In one embodiment of the present device the fixing devices thereof comprise at least one element selected from positioning elements, releasable clamping elements, depressing elements and combinations thereof. The depressing elements may, e.g., be in the form of hold down weights.

In many cases the device of the present invention may comprise at least three fixing devices, e.g., at least about 50 or at least about 100 fixing devices. The fixing devices may be arranged in longitudinal direction of the support structure at a distance of not more than about 1 m from each other, e.g., not more than about 0.5 m from each other. The fixing devices can be aligned horizontally, and at least one of them may comprise a positioning element for contacting an upper surface of the rail foot and a depressing element for contacting a lower surface of the rail foot. In another embodiment at least one fixing device may comprise a pair of releasable clamping elements having horizontally arranged alignment surfaces for contacting the rail.

One or more elements of the fixing devices that come into contact with the rail may have a shape that reduces the contact area with the rail. For example, they may be wedge-shaped.

In another embodiment of the device of the present invention the cooling device comprises a spray track with at least one of air and water. The cooling device may also comprise an immersion pool with a cooling liquid.

In another aspect of the present device, the support and the cooling device are movable relative to one another in the direction of the vertical of the rail in the cross-section. Furthermore, the support may be connected with a immersion pool having fixing devices comprising horizontally aligned positioning elements.

The support of the present device is desirably of about the same length as the rail to be supported.

An advantage resulting from a support structure that is resistant to bending and torsion is an axially aligned fixing or clamping of the rail even if during intensive cooling bending forces are generated due to different weight distribution and/or different cooling intensity over the cross-section. Just as important are the advantages of an axially aligned fixing in relation to the application of cooling medium to the surface, or wetting of the surface by cooling medium, because this way the exact alignment in desired areas of the rail is made possible with a high uniformity over the length of the rail. This way desired cooling rates, and thus desired microstructures, can be accomplished with high accuracy for predetermined cross-sectional zones.

Due to the site technology, but also with regard to use, it may be beneficial if the support structure is realized as a welded construction, on which at least three fixing devices are mounted, preferably at a distance of not more than about 0.5 m from each other over the longitudinal extent, such that they can be aligned horizontally.

A simple and reliable device is realized when releasable fixing elements take the form of depressing (holding down) elements for rails in contact with positioning elements.

It is also possible, advantageously, to design releasable fixing elements with alignment surfaces for the positioning of the rail horizontally in the axial direction.

In order to achieve a microstructure that is as uniform as possible over the length of the rail or to avoid any substantial influence on the local cooling intensity, it may be advantageous for the fixing elements, e.g., positioning elements and clamping elements, to have a reduced area of contact with the rail, for instance, to be wedge-shaped. Thus so-called "soft spots" can be avoided on the rail.

With a careful nozzle positioning and/or the utilization of water essentially free of suspended fine particles, it can be advantageous if the cooling device for the rail is designed as an air and/or water spray track with even cooling intensity over the longitudinal stretch of the rail.

If, on the other hand, the cooling device is designed as an immersion pool with a cooling liquid, the cooling intensity that acts on the immersed areas of the rail can easily be adjusted by adding synthetic substances.

Further, if the device is designed so that the rail support structure and the cooling device can be moved relative to one another in the direction of the rail vertical in cross-section, cooling cycles and/or the cooling of rail parts can be performed in a particularly efficient manner.

A particularly simple device can be realized or constructed as a retrofit, if the support structure is connected with an immersion pool comprising horizontally aligned fixing devices and the rail can be caused to contact positioning elements by means of mounting elements, for instance depressing elements. In this case the mounting elements can be designed in a particularly simple manner in the form of holding down weights, being arranged at least in the distal areas of the rail.

For an isothermal heat treatment, so to speak, it is advantageous if the device can be used for discontinuous hardening of rails or cross-sectional parts thereof.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
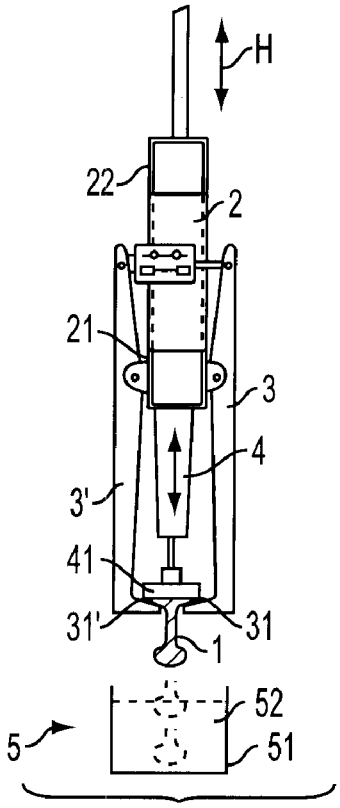
FIG. 1 shows a device for immersion tempering of hanging rails with a vertical arrangement of a fixing device

FIG. 1 schematically depicts a device is for the axially aligned fixing (clamping) of a rail 1 in a hanging position. The support structure 2 which is formed by two box profiles 22, 21 and is resistant to torsion carries movable plier-like positioning elements 3, 3' which have essentially horizontal contact areas 31, 31' for a rail 1. After the introduction of rail 1 and the closing of the positioning elements 3, 3', fixing elements (depressing elements) like that depicted at 41 can secure the axially aligned fixing of the rail, for instance by activating a hydraulic cylinder. Thereafter, the rail may be introduced, for instance by lowering the support structure 2, into a cooling device 5, e.g., an immersion pool 51 with a cooling liquid 52. After an at least partial cooling of at least a part of the rail 1 it can be removed from the cooling medium by lifting the support structure 2 in direction H and by releasing the depressing element 41 and the positioning elements 3, 3'.

Figure 2:
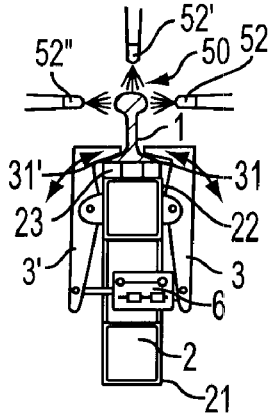
FIG. 2 shows a device for spray tempering standing rails

FIG. 2 depicts a rail 1 which is mounted in standing position in a support structure 2, secured against bending. Said support structure 2 comprises, for example, lower and upper frame boxes 21, 22, which are connected to each other in a torsion-resistant manner. For axially aligned fixing the rail 1 is placed on the positioning parts 23 and the positioning elements 3, 3' which have slanted contact areas 31, 31', are closed by pivoting, for instance, with the help of hydraulic means 6.

Figure 3:
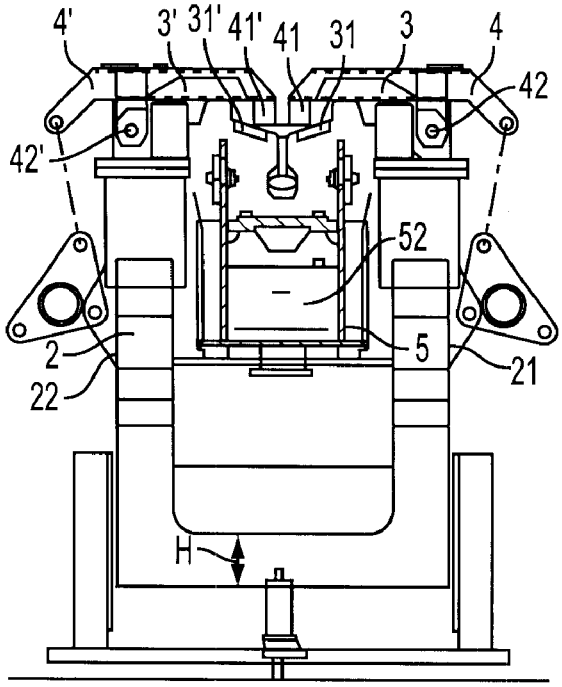
FIG. 3 shows a device with rotatable positioning of fixing elements

FIG. 3 depicts a device according to the invention which comprises laterally mounted frame elements 21, 22 of the support structure 2. For the fixing of a rail 1 which is carried by positioning elements 3, 3' with contact areas 31, 31' depressing elements 4,4' are pivoted around rotation points 42, 42' and their contact points 41, 41' are touching the foot of the rail, thus fastening the rail 1. By a relative movement in the direction of H the rail can be immersed into a cooling medium (not shown).

Figure 4:
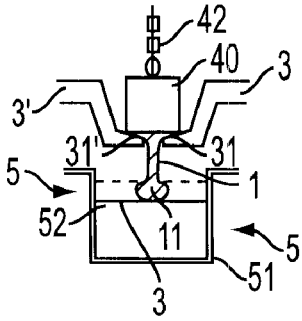
FIG. 4 shows a device having a hold down weight as depressing element

FIG. 4 schematically shows another possible horizontal positioning of a rail 1. Rail 1 with the rail head 11 pointing downward is introduced into an immersion pool 51 of a cooling device 5 with a cooling liquid 52 and is supported by positioning elements 3 provided therein. For fixing in an axially straight horizontal position, hold down weights 40 which are pivotable through retaining device 42 are placed on the rail 1, during which process the positioning elements 3, 3' can be lowered to form a small gap at the contact areas 31, 31' of, for instance 0.5 mm. For the extraction of the rail 1 out of the cooling device 5 a lifting of the hold down weights 40 and a rising of the positioning elements 3, 3' may, for example, be performed. However, cooling device 5 may be lowered as well for that purpose.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for hardening a rail or part thereof by transforming it from an austenitic structure into a different microstructure that is stable at room temperature, the process comprising aligning, horizontally positioning, and fixing in axial alignment to secure against bending, the rail in its austenitic state; and while keeping the rail fixed in axial alignment and secured against bending, force-cooling the rail or part thereof to allow the austenitic structure to be transformed into said different microstructure;

the rail having a length of at least about 50 m and being fixed in axial alignment by means of fixing elements arranged in longitudinal direction of the rail at a distance to each other of not more than about 1 m.

2. The process of claim 1, wherein the rail is force-cooled from a first temperature above an $Ac_3$-point to a second temperature which is below said $Ac_3$-point.

3. The process of claim 1, wherein the rail comprises a rail head and only the rail head is force-cooled.

4. The process of claim 1, wherein the alignment, positioning and fixing in axial alignment are conducted immediately after the last finish rolling pass.

5. The process of claim 1, wherein the rail comprises a rail head and is fixed in a standing position, with the rail head pointing upward.

6. The process of claim 1, wherein the rail comprises a rail head and is fixed in a hanging position, with the rail head pointing downward.

7. The process of claim 3, wherein the rail comprises a rail head and is fixed in a hanging position, with the rail head pointing downward.

8. The process of claim 1, wherein the rail or part thereof is force-cooled by spray cooling.

9. The process of claim 5, wherein the rail or part thereof is force-cooled by spray cooling.

10. The process of claim 8, wherein the spray cooling is performed while using equally high cooling intensities in the surface regions of the cross-section symmetrically to the height axis of the rail viewed in longitudinal direction.

11. The process of claim 1, wherein the rail or part thereof is force-cooled by immersion into a cooling liquid.

12. The process of claim 7, wherein the rail head is force-cooled by immersion thereof into a cooling liquid.

13. The process of claim 5, wherein the rail or part thereof is force-cooled intermittently with respect to at least one of time and location with regard to a surface region of the cross-section.

14. The process of claim 4, wherein after the force-cooling the rail is released and kept at an elevated temperature.

15. The process of claim 1, wherein after the force-cooling the rail is released and left to cool in ambient air.

16. The process of claim 1, wherein the length of the rail is at least about 90 m.

17. The process of to claim 16, wherein the rail or part thereof is force-cooled over approximately its entire length.

18. The process of claim 1, wherein the rail comprises a foot and the fixing elements are designed to keep the rail foot in a fixed position.

19. A process for hardening a rail or part thereof by force-cooling it from a temperature above an $Ac_3$-point with transformation of an austenitic structure into a different microstructure that is stable at room temperature, the process comprising immediately after the last finish rolling pass, aligning, horizontally positioning, and fixing in axial alignment to secure against bending, the rail in its austenitic state at a first temperature above an $Ac_3$-point; and while keeping the rail fixed in axial alignment and secured against bending, force-cooling the rail or part thereof approximately over the entire length thereof to a second temperature which is lower than said first temperature, and allowing the austenitic structure to be transformed into said different microstructure;

the rail having a length of at least about 90 m and being fixed in axial alignment at its foot by means of fixing elements arranged in longitudinal direction of the rail at a distance to each other of not more than about 0.5 m.

20. A device for hardening a rail or part thereof by force-cooling, the device comprising a support for supporting a rail having a length of at least about 50 m;

a cooling device for force-cooling the rail or part thereof; and fixing devices for axially aligning and securing the rail against bending during the force-cooling, the fixing devices being arranged in longitudinal direction of the support structure at a distance of not more than about 1 m from each other.

21. The device of claim 20, wherein the support comprises a support structure having a high resistance to bending.

22. The device of claim 21, wherein the fixing devices comprise at least one element selected from positioning elements, releasable clamping elements, depressing elements and combinations thereof.

23. The device of claim 20, wherein the fixing devices are arranged at a distance of not more than about 0.5 m from each other.

24. The device of claim 20, wherein the fixing devices can be aligned horizontally.

25. The device of claim 24, wherein the rail comprises a foot and at least one fixing device comprises a positioning element for contacting an upper surface of the rail foot and a depressing element for contacting a lower surface of the rail foot.

26. The device of claim 20, wherein at least one fixing device comprises a pair of releasable clamping elements having horizontally arranged alignment surfaces for contacting the rail.

27. The device of claim 21, wherein the support structure comprises a welded structure having the fixing devices horizontally arranged thereon.

28. The device of claim 22, wherein one or more elements of the fixing devices that come into contact with the rail have a shape that reduces the contact area with the rail.

29. The device of claim 28, wherein one or more elements of the fixing devices that come into contact with the rail are wedge-shaped.

30. The device of claim 20, wherein the cooling device comprises a spray track with at least one of air and water.

31. The device of claim 20, wherein the cooling device comprises an immersion pool with a cooling liquid.

32. The device of claim 22, wherein the support and the cooling device are movable relative to one another in the direction of the vertical of the rail in the cross-section.

33. The device of claim 31, wherein the support is connected with a immersion pool having fixing devices comprising horizontally aligned positioning elements.

34. The device of claim 22, wherein the depressing elements are in the form of hold down weights.

35. The device of claim 20, wherein the device comprises at least 100 fixing devices, each comprising at least one element selected from positioning elements, releasable clamping elements, depressing elements and combinations thereof, the fixing devices being arranged in longitudinal direction of the support structure at a distance of not more than about 0.5 m from each other, wherein the support comprises a welded support structure having a high resistance to bending, and wherein the cooling device comprises a spray track with at least one of air and water.

* * * * *